US012018377B2

(12) United States Patent
Faichuk et al.

(10) Patent No.: US 12,018,377 B2
(45) Date of Patent: Jun. 25, 2024

(54) ELECTROLESS PLATING OF OBJECTS WITH CARBON-BASED MATERIAL

(71) Applicant: Graphene Leaders Canada (GLC) Inc., Edmonton (CA)

(72) Inventors: Melissa Gail Faichuk, Edmonton (CA); Leah Shawn Coumont, Edmonton (CA)

(73) Assignee: Graphene Leaders Canada Inc., Edmonton (CA)

( * ) Notice: Subject to any disclaimer, the term of this patent is extended or adjusted under 35 U.S.C. 154(b) by 0 days.

(21) Appl. No.: 16/975,564

(22) PCT Filed: Feb. 26, 2019

(86) PCT No.: PCT/CA2019/050230
§ 371 (c)(1),
(2) Date: Aug. 25, 2020

(87) PCT Pub. No.: WO2019/161512
PCT Pub. Date: Aug. 29, 2019

(65) Prior Publication Data

US 2020/0399760 A1 Dec. 24, 2020

Related U.S. Application Data

(60) Provisional application No. 62/635,024, filed on Feb. 26, 2018.

(51) Int. Cl.
*C23C 18/34* (2006.01)
*C23C 18/16* (2006.01)

(52) U.S. Cl.
CPC ..... *C23C 18/34* (2013.01); *C23C 18/1662* (2013.01)

(58) Field of Classification Search
None
See application file for complete search history.

(56) References Cited

U.S. PATENT DOCUMENTS

| | | | |
|---|---|---|---|
| 5,145,517 | A | 9/1992 | Feldstein et al. |
| 5,300,330 | A | 4/1994 | Feldstein et al. |
| 5,389,229 | A | 2/1995 | Feldstein et al. |
| 5,707,725 | A | 1/1998 | Feldstein et al. |
| 5,863,616 | A | 1/1999 | Feldstein et al. |
| 6,156,390 | A | 12/2000 | Henry et al. |

(Continued)

FOREIGN PATENT DOCUMENTS

| | | | |
|---|---|---|---|
| CA | 2 875 317 | A1 | 12/2013 |
| CA | 2875317 | A1 | 12/2013 |

(Continued)

OTHER PUBLICATIONS

International Search Report issued in corresponding PCT application No. PCT/CA2019/050230 dated May 6, 2019.

(Continued)

*Primary Examiner* — Shamim Ahmed
*Assistant Examiner* — Bradford M Gates
(74) *Attorney, Agent, or Firm* — Finch & Maloney PLLC

(57) ABSTRACT

A metalizing bath for an electroless plating system includes a metal ion source, a reducing agent, insoluble particulate matter, and stabilizing components, wherein the stabilizing components comprise at least one anionic surfactant and at least one cationic surfactant.

13 Claims, 1 Drawing Sheet

(56) References Cited

U.S. PATENT DOCUMENTS

| | | | | |
|---|---|---|---|---|
| 6,306,466 | B1 * | 10/2001 | Feldstein | C23C 18/31 427/437 |
| 6,309,583 | B1 | 10/2001 | Feldstein | |
| 8,147,601 | B2 | 4/2012 | Feldstein et al. | |
| 9,175,399 | B2 | 11/2015 | Brunner et al. | |
| 2006/0251910 | A1 | 11/2006 | Lancsek et al. | |
| 2013/0216720 | A1 | 8/2013 | Pearson et al. | |
| 2014/0287208 | A1 | 9/2014 | Feldstein et al. | |
| 2015/0110965 | A1 * | 4/2015 | Brunner | C23C 18/1633 427/430.1 |
| 2016/0010214 | A1 | 1/2016 | Morcos et al. | |
| 2017/0009350 | A1 * | 1/2017 | Myllymaki | C25D 5/50 |

FOREIGN PATENT DOCUMENTS

| | | | |
|---|---|---|---|
| CN | 103361637 | A | 10/2013 |
| CN | 103556136 | A | 2/2014 |
| CN | 103556138 | A | 2/2014 |
| CN | 107699872 | A | 2/2018 |
| GB | 2 233 982 | A | 1/1991 |
| JP | 2006257460 | A | 8/2006 |
| JP | 2006-257460 | A | 9/2006 |
| JP | 2014-214341 | A | 11/2014 |
| JP | 2014214341 | A | 11/2014 |
| WO | 2016007320 | A1 | 1/2016 |

OTHER PUBLICATIONS

Written Opinion issued in corresponding PCT application No. PCT/CA2019/050230 dated May 6, 2019.

Malfatti et al: "The surfactant addition effect in the elaboration of electrodepositated NiP-SiC composite coatings", Surface and Coatings Technology, Elsevier, NL, vol. 201, No. 14, Feb. 20, 2007 (Feb. 20, 2007), pp. 6318-6324, See European Search.

European Search Report Corresponding to 19757091.4 dated Mar. 10, 2022.

* cited by examiner

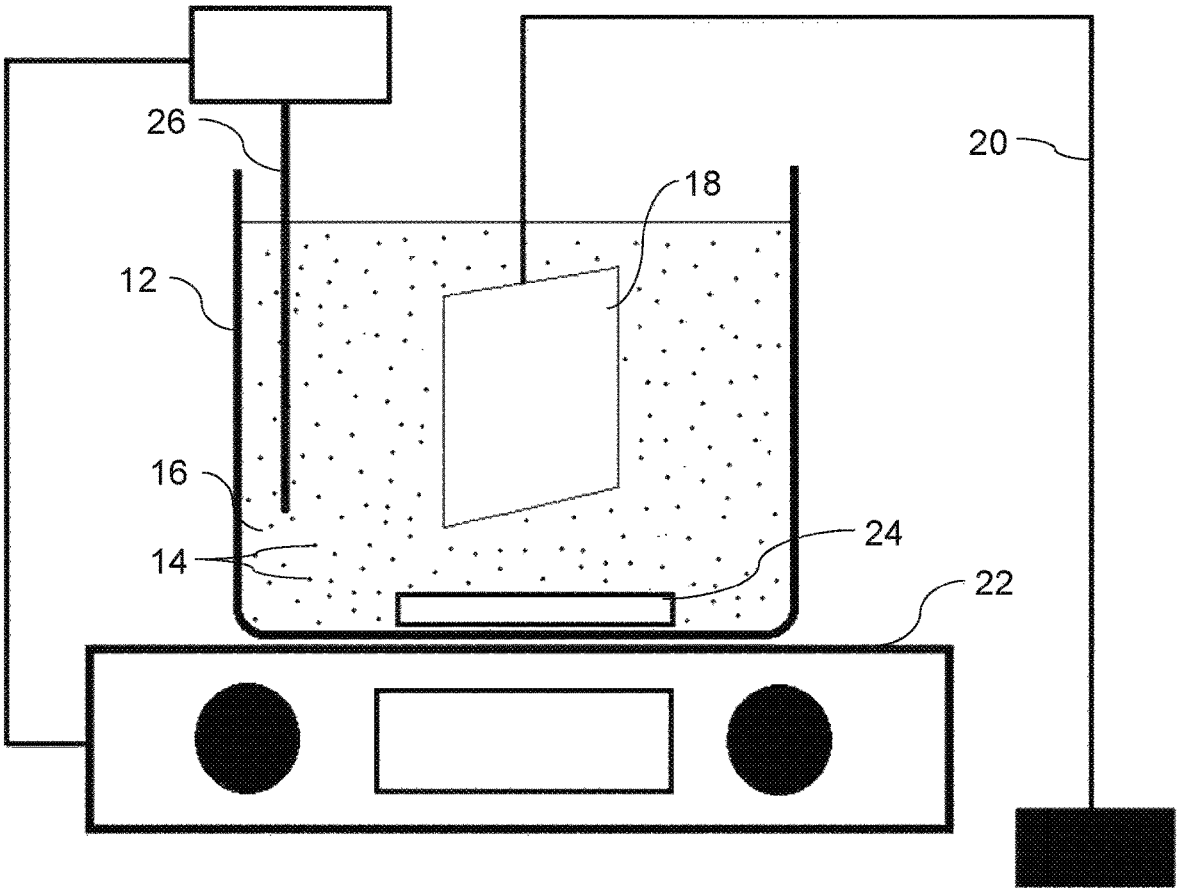
26
20
18
12
16
24
14
22

ELECTROLESS PLATING OF OBJECTS WITH CARBON-BASED MATERIAL

TECHNICAL FIELD

This relates to the electroless plating of objects with insoluble particulate matter, which may include graphene, graphite, or other carbon-based material.

BACKGROUND

Composite electroless coatings, typically nickel, containing particulate matter is a recent advancement in the field of metal electroplating, and success has been well documented. The electroless nickel plating process is a well-known and understood method of applying an alloyed coating to a wide variety of substrates. Electroless nickel coatings have unique properties such as excellent corrosion resistance, abrasive wear resistance, magnetic and non-magnetic properties (depending on phosphorus content), excellent adhesion and low coefficients of friction. Application of heat treatment at 400° C. can improve upon some of these characteristics, such as abrasive wear and hardness. An additional property of the process that makes it unique compared to other electroplating techniques is the ability to plate uniformly over any surface geometry.

The process of electroless nickel plating refers to the autocatalytic reduction of a metal ion, commonly nickel, in the presence of a chemical reducing agent. These baths often contain a mixture of buffers, complexing agents, and stabilizing components, which, in addition to the metal ions and reducing agents are required to be maintained at specific ratios for optimal operation and performance. Additional plating parameters that must be carefully monitored and controlled are pH, temperature and exposed substrate surface area.

Initially, most conventional electroless plating baths were not well suited to composite plating, as the bath components and chemistry were not formulated for such a high exposed surface area. These findings were based on the fact that addition of insoluble particulate matter to the electroless plating baths, without proper filtration mechanisms, resulted in decomposition. Significant work has been completed in developing electroless nickel formulations that include particulate materials in the electroless nickel bath, while maintaining stability, plating rate and adhesion, and successful co-deposition of particulate matter into the alloyed coating matrix.

An example of a composite electroless plating process is described in U.S. Pat. No. 8,147,601 (Feldstein et al.) entitled "Composite electroless plating".

SUMMARY

There is provided a method for the co-deposition of insoluble particulate matter, which may be carbon-based materials, such as graphene or graphite (herein referred to as "graphene materials"), by deposition in an electroless plating system. The carbon-based materials are stabilized in the aqueous electroless plating solution using a stabilizing component, made up of a mixture of anionic and cationic surfactants. This may aide in uniformly distributing the carbon-based materials in the coating. The co-deposition of the carbon-based material using these combinations of surfactants may also be used to improve numerous physical properties including the hardness, and resistance to corrosion and abrasive wear of the parent coating. The stability of the electroless nickel plating solution with the addition of carbon-based material, and successful co-deposition of the carbon-based material into the alloy matrix, is dependent on the stabilizing component concentration and ratio, as well as plating conditions, among other variables. The substrate to be plated is typically pre-treated or cleaned, where the method of pre-treatment is dependent on the nature of the substrate, which can include various metals and non-metals. Pre-treatment is often necessary for optimal plating initiation, and adhesion of the coating to the substrate surface. During the plating process, the carbon-based materials are stabilized using the stabilizing components, allowing for fine, uniform distribution in the plating bath. This stabilized distribution of particles in the bath can improve the consistency of co-deposition of the carbon-based material within the coating. Heat treatment is often utilized for a coating used in high wear environments. According to one aspect, heat treatment at 400° C. for 1 hour may be used. The result is a precipitation hardening of the matrix, particularly in the case of nickel phosphorus (Ni—P) type coatings.

According to an aspect, there is provided a metalizing bath for an electroless plating system comprising, in solution, metal ions, a reducing agent, and stabilizing components, and insoluble particulate matter suspended in the solution. The stabilizing components comprise at least one anionic surfactant and at least one cationic surfactant.

According to other aspects, the metalizing bath may comprise one or more of the following: the reducing agent may be a chemical reducing agent; the metal ion may be derived from a metal compound or a metal salt dissolved in the solution; the metal ion may be derived from a nickel compound or a nickel salt dissolved in the solution; the particulate matter may comprise a carbon-based material, and the carbon-based material may comprise one or more materials selected from a group consisting of: graphite, single layer graphene, multi-layer graphene, graphene oxide, reduced graphene oxide, expanded graphite graphene, and a graphene-derivative material; the graphene or graphite may have an average particle size of less than 100 microns; the stabilizing components may further comprise dispersing agents; the stabilizing components may comprise a ratio of cationic to anionic surfactants in a range of between 1%:99% to 99%:1%; the stabilizing components may have an aggregate concentration of between 0.1 ppm and 10,000 ppm; the carbon-based material source may have a loading factor of between 0.01% and 10%; and the carbon-based material may have a loading factor of between 0.1% and 1%.

According to another aspect, there is provided a method of electroless plating, comprising the steps of: providing a metalizing bath comprising metal ions, a reducing agent, and stabilizing components in solution, typically an aqueous solution, and insoluble particulate matter suspended in the solution, the stabilizing components comprising at least one anionic surfactant and at least one cationic surfactant; and submerging a surface in the solution and causing the surface to be plated.

According to other aspects, the method may comprise one or more of the following: the reducing agent may be a chemical reducing agent; the metal ions may be provided by dissolving a metal compound or a metal salt in the solution; the metal ions may be provided by dissolving a nickel compound or a nickel salt in the solution; the particulate matter may comprise a carbon-based material; the carbon-based material may comprise one or more materials selected from a group consisting of: graphite, single layer graphene, multi-layer graphene, graphene oxide, reduced graphene oxide, expanded graphite graphene, and a graphene-derivative material; the graphene or graphite may have an average particle size of less than 100 microns; the stabilizing components may comprise surfactants, dispersing agents, or combinations thereof; the stabilizing components may comprise a ratio of cationic to anionic surfactants in a range of between 1%:99% to 99%:1%; the stabilizing components may have an aggregate concentration of between 0.1 ppm and 10,000 ppm; the carbon-based material source may have a loading factor of between 0.01% and 10%; the carbon-based material may have a loading factor of between 0.1% and 1%.

Other aspects will be apparent from the claims and description below.

In other aspects, the features described above may be combined together in any reasonable combination as will be recognized by those skilled in the art.

BRIEF DESCRIPTION OF THE DRAWINGS

These and other features will become more apparent from the following description in which reference is made to the appended drawings, the drawings are for the purpose of illustration only and are not intended to be in any way limiting, wherein:

FIG. 1 is a schematic of an experimental design.

DETAILED DESCRIPTION

There will now be described a process for electroless plating using carbon-based material. The description will be given in the context of graphene, which is a preferred material, but it will be understood that other insoluble particulate materials may also be used. One such alternative, carbon-based material is graphite. A reference to graphene herein will be understood to also refer to other materials that have suitable properties. The term "electroless plating" generally refers to the deposition of a metallic or alloyed coating onto a substrate surface through an autocatalytic deposition process. The term "alloyed coating" refers to a coating which contains at least 2 elements. In many cases, this will be a mixture of Ni and P, although other alloys may also be possible.

The formation of the coating occurs on the surface of metal objects submerged in a solution of the metal ion source, a reducing agent, stabilizing components and other additives, in addition to the suspended particulate matter. This electroless nickel solution is prepared in a solvent, which is ordinarily water.

A chemical reducing agent is used to reduce the metal ions to elemental form that form the coating. In a preferred example, the metal ions are nickel ions that are reduced to elemental nickel to form the nickel alloy coating, although other elements may also be used. Additionally, the choice of reducing agent may also influence the composition of the deposited coating. With these purposes in mind, there are several aspects relating to the reducing agent which make it suitable for this purpose. Firstly, the reducing agent is preferably selected to have sufficient reducing power to achieve an autocatalytic process. Additionally, the reducing agent is preferably chosen such that the reduction reaction generates the alloy of the correct composition to give the properties desired for the application. For example, sodium borohydride is often used in electroless nickel processes as a reducing agent which then generates a Ni—B coating. Likewise, hydrazine may also be used as a reducing agent to generate a pure nickel coating, as opposed to an alloy. Hypophosphite ion may also be used as a reducing agent in electroless nickel coatings which generates a Ni—P coating in which the phosphorus content can be modified to generate coatings with a range of properties that can be selected according to application. Given the useful properties of the Ni—P coating, its versatility according to phosphorus content, in addition to its relatively low cost, and stability, sodium hypophosphite-based systems are generally preferred.

Additionally, in a preferred embodiment, nickel is used as a metal ion salt. Other metals may also be used, such as silver, copper, tin, and cobalt. However, the discussion below will focus on nickel due to cost considerations and the availability of a suitable commercial chemical.

It has been found that the use of carbon-based material additives to the Ni—P coating may be used to achieve beneficial results, but many composite coatings may also be prepared using a variety of materials. These coatings may contain additives including one or more of both hard particles such as silicon carbide (SiC), diamond, and alumina, and soft particles such as polytetrafluoroethylene (PTFE), and hexagonal boron nitride. Each particle has a specific set of benefits and drawbacks. For example, hard particles often add hardness and resistance to abrasive wear, but this is often at the expense of other desirable properties such as the lubricity, and corrosion resistance properties of the material. Likewise, while soft particles may substantially improve the lubricity of the coating, often the overall hardness of the material may remain unchanged. Carbon-based materials such as graphite, and graphene offer an excellent alternative to existing soft particles due to their large aspect ratios and excellent strength which may improve both the lubricity and wear resistance of EN coatings. These benefits may also be realized in ternary systems with other particles such as those mentioned above.

As used herein, the term graphene may refer to single, double or multilayer graphene, as well as graphene material derivatives unless the context makes it clear graphene alone is being described. Generally speaking, the term graphene describes a carbon-based material composed of atomic sheets of carbon arranged in a hexagonal lattice, and particles composed of these base units can vary in overall size, lateral dimension and layer thickness. Graphene can be classified as single layer graphene (SLG), bilayer graphene (BLG—two layers thick), and few-layer graphene (FLG—3-10 layers). The term graphite refers to any graphitic material with layer thicknesses greater than 10. Graphene material derivatives include graphene oxide, reduced graphene oxide, functionalized graphene and expanded graphite. With the exception of graphene oxide, the graphene, graphite and graphene material derivatives mentioned above are typically insoluble in water and require additional functionalization or modification for stable dispersion in aqueous media.

Graphene is a unique material formed from an atomic layer of sp2 hybridized carbon. Graphene may be one or more layers thick, where multiple layers of graphene stacked on top of one another may be referred to as graphite. Typically, graphene is considered to have less than 10 atomic layers, while graphite is considered to have more than 10 atomic layers, and may be labelled as graphite nanoplatelets. Despite the similarities in structure and composition, the properties of graphene can differ significantly from graphite. For example, graphene has superior lubricity properties compared to graphite, and is more flexible. As a result of the 2-dimensional structure and chemical bonding, graphene possesses incredible strength, electronic and thermal energy conduction properties, and high charge carrier mobility. Graphene has potential applicability in the fields of nanoelectronics, energy storage materials, polymer composition materials, and sensing technologies.

While graphene is an emerging technology that has found uses in many different applications, it has been shown to be an incredibly difficult material to work with in many instances, due to the unusual behaviour and properties it exhibits. For example, a difficulty in combining graphene materials in electrolessly plated alloy matrices, such as Ni—P matrices, is finding a stabilizing component that is compatible with both the graphene and the electroless plating solution, that will effectively stabilize the graphene material and prevent restacking and aggregation in the electroless nickel plating solution. This challenge has posed a significant technological barrier to fully realizing the potential property enhancements that could arise from development of such carbon-based material containing coatings.

For example, graphite in particular, with relatively low loadings, has been observed to reduce the coefficient of friction in EN coatings, but to the best of our knowledge no work has been completed to investigate the impact of the surfactant nature, concentration, or impact of two-surfactant mixtures on the efficiency of co-deposition, and bath performance. This strategy, in part, arises because the properties of Ni—P deposited in the presence of particulate additives tend to be dependent to the size, shape and concentration of particle in the coating. Additionally, since the lubricity mechanism in the graphene material is sheet slippage, multilayer graphene or graphite nanoflakes will give a similar benefit to the coating as will few layer graphene. For these reasons, we have targeted graphene as a preferred carbon source in EN coating.

To accomplish this goal graphene and graphite obtained through the liquid phase mechanical exfoliation of flake graphite may be used. The exfoliation of flake graphite into graphene requires counteracting the enormous van der Waals attraction between graphene layers. Some methods for achieving exfoliation include ultra-sonication or shear-mixing-assisted exfoliation in organic solvent or surfactant solution; electrochemical exfoliation of graphite in electrolyte; and chemical reduction of exfoliated graphite oxide, with defect concentrations from low to high. Often exfoliation is incomplete, meaning a certain portion of the exfoliated material may be classified as graphene, with the remainder being greater than about 10 layers in thickness and being more consistent with graphite. These production processes result in a bulk material with a broad distribution of particle sizes with some percentage of graphene (e.g., less than 10 layers thick), and the remainder composed of nanoparticulate graphite (>10 layers thick).

When the carbon-based materials are being incorporated into a product or process that involves the liquid phase, such as the electroless nickel bath components, the dispersion quality is extremely important. In general, dispersion quality is measured by the ability of the material to resist aggregation and settling. More specifically to carbon-based materials in the electroless nickel plating solution, a high dispersion quality is one in which the electroless nickel plating solution appears, black to silver and homogeneous, without observation of visible aggregation within the bath. The generation of a high-quality dispersion of the hydrophobic carbon-based materials in the aqueous electroless nickel bath solution is achieved using stabilizing components.

Stabilizing components, which generally refers to surfactants, dispersing agents, or combinations thereof, are added to the bath containing the carbon-based materials to assist in stabilizing the material in an aqueous environment. The stabilizing components may be used to modify the overall charge on the particle surface, causing a shift in the zeta potential. This will alter how the carbon-based materials behave in the electroless plating solution. For the purpose of the method described herein, the stabilizing components are a blend of anionic and cationic surfactants.

Being that the process of the electroless nickel plating is autocatalytic and surface-driven, the suspension of particulate matter within the bath presents a unique problem. In particular, the presence of the particulate matter increases the accessible surface area for plating within the bath by several orders of magnitude, increasing the probability of bath instability, plate out, and loss of chemical. To mitigate this problem stabilizing components are preferably used that serve 2 purposes: 1) to stabilize the surface of particles preventing spontaneous plate-out due to the very high surface area, and 2) to ensure even distribution of particles in the bath which helps facilitate the co-deposition within the growing electroless nickel coating.

In addition to the chemical structure of the surfactants, their concentration and relative ratio may also impact the bath chemistry and the EN coating. Historically, cationic surfactants and anionic surfactants have been used alone and in combination with non-ionic surfactants to stabilize particles in the EN bath. It has been shown in other electroless plating systems that the surfactant can impact plating rate, as well as the physical properties of the resultant coating. In addition, the stabilization of the particles in a bath using dispersing agents can occur via a number of mechanisms, which is highly dependent on the charge and overall structure of the surfactants. For example, the structure of the hydrophobic moiety influences how well the surfactant will interact with the carbon-based material; generally long chain aliphatic groups or benzyl containing surfactants will suit this purpose well. Another important consideration is the impact of the surfactant choice on the co-deposition of the particle, which is highly dependent on the particle charge. In the electroless nickel coating process the surface of the substrate is anodic, as such using a cationic surfactant to give the particle surface an overall positive charge improves co-deposition. While the anionic surfactants generally do not offer this same property, they have been demonstrated to act as stabilizing components in the EN baths by coordinating to the active metals resulting in stronger particle bonding. By using blends of anionic and cationic surfactants it is possible to balance the effects of the surfactants on both the dispersion and the bath chemistry to be able to successfully co-deposit the carbon-based material with the desired composition and properties.

The overall concentration of stabilizing components within the bath can have a significant impact on the stability of the dispersed particles, and on the chemistry of the bath itself. For example, utilization of certain surfactants has been shown to impact the rate of deposition, and physical properties of the resultant coating. Similarly, when used to disperse a particulate additive such as graphene or graphite, a certain base concentration of surfactant may be required to coat the surface of the suspended particle. In excess of this amount, the stabilizing components may interfere with the bath chemistry or result in the formation of micelles which causes particle aggregation. In this context, the concentration of stabilizing additive may be highly variable, and may require very specific conditions to stabilize the particles to be co-deposited, while simultaneously enhancing the physical properties of the Ni—P—C composite. For example, given the potential for variability in the thickness and aspect ratio of the carbon-based materials used in the electroless plating bath, the exposed surface area of the particles should also be considered when determining the ideal concentration of stabilizing components. This may be accomplished by carefully controlling the both the ratio of anionic to cationic surfactants, and overall surfactant concentration.

The physical properties of the EN coating generated through the co-deposition of a particulate requires that the concentration of particles should be within some optimal range in the plating bath, and typically that concentration is very large. For example, maximum hardness in a SiC co-deposit EN coating may be obtained between 20-25% wt./vol. SiC. Likewise, the maximum friction reduction in PTFE co-deposit EN coatings has been found to be between 20-25% wt./vol. Unlike these very high concentrations, the possible range for the concentration of the carbon-based material in the electroless nickel bath may be between 0.01% and 10% wt./vol. and in a preferred example, the graphene/graphite concentration may be between 0.1% and 1% wt./vol., in part because this is where co-deposition is observed to be effective, and also due operational limitations relating to bath maintenance.

In one example, an electroless plating system contains a metal ion source, a reducing agent, such as a chemical reducing agent, insoluble particulate matter and stabilizing components. The metal ion source may be a metal salt, such as a nickel-based component or other suitable component. The particulate matter may be a carbon-based material such as graphite, graphene, or a graphene derivative material, and may be single layer graphene, multi-layer graphene, graphene oxide, reduced graphene oxide, expanded graphite, or graphite, and preferably have an average particle size of less than 100 microns. The stabilizing components may be surfactants, dispersing agents, or the like, and preferably includes a mixture of at least one anionic surfactant and at least one cationic surfactant. The stabilizing components may have a ratio of cationic to anionic surfactants that are in a range of between 1%:99% to 99%:1%. The overall concentration of stabilizing components may be in a range of 0.1 ppm to 10,000 ppm.

In another example, the loading of carbon-based materials may be between 0.1 to 1% wt./vol. in a Ni—P matrix, although lower or higher loadings from 0.01% to 10% wt./vol. may also be possible. The loading and aspect ratio of carbon-based materials to the electroless nickel plating solution may have a direct impact on both the concentration/ratio of stabilizing components required for optimal plating, and the degree of co-deposition in the plated alloy matrix.

The stabilizing components may be a mixture of anionic and cationic surfactants, where the percentage of anionic surfactant in the overall surfactant blend may range from 1% to 99% with the remainder consisting of the cationic surfactant. The stabilizing components selected for the graphite or graphene materials are selected to be compatible with both the electroless nickel bath components, chemistry and operating conditions, and the carbon-based materials. In this context, compatibility means that the deposition process is not interrupted by the stabilizing component such that it would cause rapid plate out or otherwise does not impair the deposition process, or cause aggregation and settling of the carbon-based material. Several different surfactant types (e.g., cationic, anionic or non-ionic) demonstrate acceptable compatibility with graphite or graphene materials and the electroless nickel bath. In general, the stabilizing component concentration utilized will be based at largely on the carbon-based material loading, and surface area of the material which is a function of the thickness and lateral dimensions of the flakes used. For example, for a loading of between 0.1 to 1% wt./vol. carbon-based material in an electroless nickel bath, the stabilizing component may be in the range of 1 to 1000 ppm.

A detailed example of one such experiment follows.

Example 1

FIG. 1 shows a setup that was used to perform the experiment described below. It will be understood that other setups may be used, whether for experimental, small batch processing, or commercial implementations, depending on the preferences of the user and the requirements of the system. An electroless plating bath 12 was used that included suspended particles 14 suspended in a solution 16. A substrate 18 to be plated was suspended in solution 16 using a stand 20. Bath 12 was placed on a hot plate/magnetic mixer 22 to maintain the temperature of solution 16 within a desired temperature range, as monitored by temperature probe 26, and to agitate solution 16 using magnetic stir bar 24.

A commercially available high phosphorus (HP) electroless nickel was used for the experiment described below. The make-up of bath 12 strictly followed all protocols set out by the bath supplier to ensure consistent results were achieved as many different baths were made over the course of this testing. The following bath parameters were maintained within the suggested ranges for all prepared baths including all control and PG baths.

Nickel Concentration—range from 5.8-6.2 g/l pH—range from 4.6-5.1

Operating Temperature—range from 85-89° C.

Bath Loading—range from 0.5-2.5 sq. dm/l

A 1600 mL HP electroless nickel plating solution 16 was prepared, with a pH of 4.9 and a nickel concentration of 6.0 g/l 200 ml of which was set aside for the graphene nanomaterial dispersion. Dispersing agent Cetrimonium bromide (CTAB) was added to the 200 mL EN plating solution to achieve a concentration of 250 ppm in 1600 mL. A second dispersing agent, Triton X-200 which was received as a 28% aqueous solution, was added as a concentration of 0.5 μL per mL of total EN plating solution. The targeted loading for the EN plating solution was 0.1 wt. % and 1.6 g of graphene nanomaterials 14 was added to 100 mL of the concentrated dispersing agent/EN plating solution. The dispersing agent/graphene nanomaterial slurry was placed in a JAC ultrasonic bath and sonicated at room temperature for 30 minutes, after which the slurry was added to the entire EN plating solution 16, using the remaining 100 mL of concentrated surfactant/EN plating solution for rinsing. The EN plating solution containing the graphene nanomaterials was heated using hot plate 22 to an operating temperature of 88° C. in a water bath, where the temperature was maintained using an ETS-D4 thermocouple 26. Substrates 18 chosen for plating included a Taber panel and a Q panel, whose composition was SAE Material Designation: 1008/1010 steel. Pre-treatment of the test panels 18 began with the removal of any solid, rough, adhered material through manual abrasive methods, such as scrubbing or sandblasting. The test panels 18 were weighed prior to receiving an initial was using a surfactant solution to remove and oil or organic debris. The panels 18 were then placed in a hot caustic solution (200 g/L NaOH, 90° C.) for 5 minutes, after which they were rinsed in triplicate with water. The panels were placed in a room temperature solution of 5% $H_2SO_4$ solution for 1 minute, after which they were rinsed in triplicate with water. The graphene nanomaterials 14 were dispersed in the EN plating solution 16 utilizing manual methods during both heating and plating phases.

Following the completion of the electroless nickel plating, the coated panels 18 were rinsed with water, dried and weighed to determine a final coating thickness. The EN plating solution temperature was monitored using a mercury thermometer. The EN plating solution pH was monitored using a Denver Instruments Accumet pH meter. The nickel content of the EN plating solution was checked at regular 20-minute intervals using an EDTA titration using the procedure below In a 250 mL volumetric flask, 40 mL DI water, 10 mL $NH_4OH$, 1 mL plating solution and a small amount of murexide indicator were mixed. The solution was then titrated with 0.01M EDTA to the purple endpoint. Based on the titration results we used the recommended replenishing schedule supplied by the bath chemical company to keep the nickel concentration at 6.0 g/l throughout the plating process. The pH was checked at 30-minute intervals as well and adjusted using dilute $NH_4OH$ to keep the bath in the optimal pH range of 4.8 to 4.9. The test panels 18 were removed from the EN bath 12 after 3½ hours. Upon removal the panels 18 were rinsed and rinsed with hot water, then dried and weighed to determine the coating thickness.

In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be one and only one of the elements.

The scope of the following claims should not be limited by the preferred embodiments set forth in the examples above and in the drawings, but should be given the broadest interpretation consistent with the description as a whole.

What is claimed is:

1. A metalizing bath for an electroless plating system, comprising:

in solution, metal ions, a reducing agent, and stabilizing components; and graphene suspended in the solution;

wherein:

the graphene has an average particle thickness of 10 layers or less and a concentration of between 0.1% and 1% wt/vol.;

the stabilizing components comprise at least one anionic surfactant and at least one cationic surfactant;

a ratio of the at least one anionic surfactant to the at least one cationic surfactant and a concentration of the stabilizing components are selected to modify a surface charge of the graphene sufficient to achieve a stable dispersion of graphene within the solution and to permit a co-deposition of graphene within a metal coating; and a concentration of the stabilizing components is between 0.1 and 1,000 ppm.

2. The metalizing bath of claim 1, wherein the reducing agent is a chemical reducing agent.

3. The metalizing bath of claim 1, wherein the metal ions are derived from a metal compound or a metal salt dissolved in the solution.

4. The metalizing bath of claim 1, wherein the metal ions are derived from a nickel compound or a nickel salt dissolved in the solution.

5. The metalizing bath of claim 1, wherein the stabilizing components comprise a ratio of cationic to anionic surfactants in a range of 1:99 mol % to 99:1 mol %.

6. A method of electroless plating, comprising the steps of:

providing a metalizing bath comprising metal ions, a reducing agent, and stabilizing components in solution, and graphene suspended in the solution, wherein the graphene has an average particle thickness of 10 layers or less;

the stabilizing components comprise at least one anionic surfactant and at least one cationic surfactant; and a concentration of the stabilizing components is between 0.1 and 1,000 ppm;

selecting the concentration of the stabilizing components and a ratio of the at least one anionic surfactant to the at least one cationic surfactant such that a surface charge of the graphene is sufficiently modified to achieve a stable dispersion of graphene within the solution and to promote a co-deposition of graphene within a metal coating; and submerging a surface in the metalizing bath and causing the surface to be plated.

7. The method of claim 6, wherein the reducing agent is a chemical reducing agent.

8. The method of claim 6, wherein the metal ions are provided by dissolving a metal compound or a metal salt in the solution.

9. The method of claim 6, wherein the metal ions are provided by dissolving a nickel compound or a nickel salt in the solution.

10. The method of claim 6, wherein the stabilizing components comprise surfactants, dispersing agents, or combinations thereof.

11. The method of claim 6, wherein the stabilizing components comprise a ratio of cationic to anionic surfactants in a range of 1:99 mol % to 99:1 mol %.

12. The method of claim 6, wherein the graphene has a loading factor of between 0.01 wt./vol. % and 10 wt./vol. %.

13. The method of claim 6, wherein the graphene has a loading factor of between 0.1 wt./vol. % and 1 wt./vol. %.

* * * * *